United States Patent [19]

Thomson

[11] Patent Number: 4,579,298

[45] Date of Patent: Apr. 1, 1986

[54] DIRECTIONAL CONTROL DEVICE FOR AIRBORNE OR SEABORNE MISSILES

[75] Inventor: Keith D. Thomson, Hawthorn, Australia

[73] Assignee: The Commonwealth of Australia, Canberra, Australia

[21] Appl. No.: 716,615

[22] PCT Filed: Mar. 30, 1982

[86] PCT No.: PCT/AU82/00044

§ 371 Date: Dec. 2, 1982

§ 102(e) Date: Dec. 2, 1982

[87] PCT Pub. No.: WO82/03453

PCT Pub. Date: Oct. 14, 1982

Related U.S. Application Data

[63] Continuation of Ser. No. 451,147, Dec. 2, 1982, abandoned.

[30] Foreign Application Priority Data

Apr. 8, 1981 [AU] Australia ..... PE8383

[51] Int. Cl.[4] ..... F42B 15/027

[52] U.S. Cl. ..... 244/3.21; 114/23; 244/3.1; 244/3.23

[58] Field of Search ..... 244/3.1, 3.15, 3.16, 244/3.19, 3.21, 3.23; 114/20 R, 21 A, 23; 102/384

[56] References Cited

U.S. PATENT DOCUMENTS

| | | | |
|---|---|---|---|
| 1,250,178 | 12/1917 | Hover | 114/23 |
| 2,594,766 | 4/1952 | Goddard | 244/3.1 |
| 3,067,682 | 12/1962 | Feldmann et al. | 244/3.23 |
| 3,069,112 | 12/1962 | Patterson | 244/3.19 |
| 3,111,088 | 11/1963 | Fisk | 244/3.16 |
| 3,262,655 | 7/1966 | Gillespie | 244/3.1 |
| 4,076,187 | 2/1978 | Metz | 244/3.23 |
| 4,142,696 | 3/1979 | Nottingham | 244/3.16 |
| 4,399,962 | 8/1983 | Wedertz et al. | 244/3.23 |
| 4,426,048 | 1/1984 | Mildren | 244/3.23 |

FOREIGN PATENT DOCUMENTS

| | | | |
|---|---|---|---|
| 434933 | 7/1912 | France | 114/23 |

OTHER PUBLICATIONS

Navy Technical Disclosure Bulletin, vol. 5, No. 8, Aug. 1980, pp. 19–23, "Articulated Nose Missile Configuration".

*Primary Examiner*—Charles T. Jordan

*Attorney, Agent, or Firm*—Cushman, Darby & Cushman

[57] ABSTRACT

A missile for airborne and seaborne use in which directional control about a flight axis comprises a nose (2) deflectable angularly in relation to the flight axis of the body (1) of the missile to form steering means by changing the fluid flow involve over the body (1) and means (4,5) between the nose (2) and the body (1) to effect angular deflection about a universal pivoting point (3) between the nose (2) and the body (1).

7 Claims, 3 Drawing Figures

DIRECTIONAL CONTROL DEVICE FOR AIRBORNE OR SEABORNE MISSILES

Figure 1:
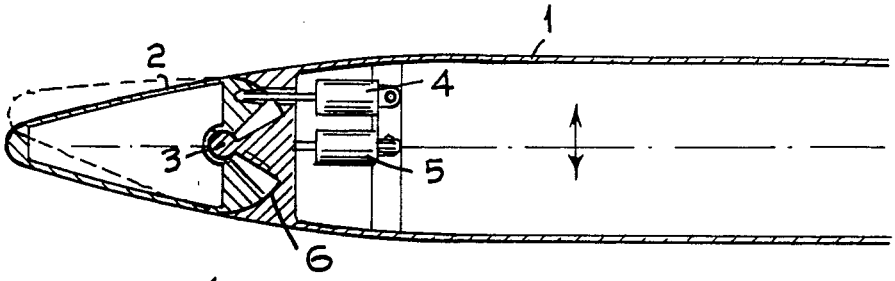

This is a continuation of application Ser. No. 451,147, filed Dec. 2, 1982, which was abandoned upon the filing hereof.

This invention relates to directional control means for airborne or seaborne missiles.

Most controllable vehicles such as missiles are steered by deflecting a set of control surfaces attached to the rear of the body. However, in recent years there has been a significant amount of research into the performance of canard control systems. This research has received impetus from the trend to extend the role and performance of existing missiles by the additon of modules; an example is the conversion of standard bombs into "smart" bombs. In such cases it is attractive, and simple in principle, to remove the front fuse and replace it by a target sensor, some rudimentary intelligence, and a control system to fly the missile towards a selected target. However, the protruding canard controls can cause a packaging problem in certain circumstances and, furthermore, their aerodynamic performance is not as good as might be expected; it might be thought that canards have an advantage over rear controls in that the lift force they generate in setting a statically stable missile at a trimmed incidence is in a direction to increase the missile's normal acceleration, whereas rear controls oppose the normal acceleration. However, if the missile carries lifting surfaces a few body diameters downstream of the canards, these surfaces tend to act as flow straighteners and remove the down-wash imparted by the canard controls. In doing so they experience a decrease in normal force roughly equal to the canard control normal force. The net effect is that the canards provide a pitching moment and generally only a small contribution to the normal acceleration of the missile.

It is an object of this invention to provide an improved form of control which will be simple to apply but effective in directional control and this is achieved according to this invention by use of a deflectable nose, preferably being able to deflect in any plane.

Such a device would not affect the packaging characteristics of a missile, and because any nose lift due to nose deflection is accompanied by down-wash generally in the lee of the body rather than spread laterally in the flow, downstream lifting surfaces may not be so effective in removing down-wash. It will be realized that a very simple missile steering method can be achieved by the nose always being pointed towards the target. The forces acting on the missile would then fly the missile towards the target.

It is of course known that an aircraft is known which uses a droop nose, but this is merely to give visibility of the runway when landing the aircraft and no use is made of the droop nose for directional control.

Wind tunnel tests on the effectiveness of a deflectable nose on a typical missile body have been conducted, using a slender ogive-cylinder with a rounded nose, and part of the curved nose was made deflectable. No lifting surfaces were attached to the model, the objective being to determine the control effectiveness of the deflectable nose in the absence of control or lifting surface interference. Force and moment measurements were made at both subsonic and supersonic speeds and the results show that such control is effective and can be readily applied to vehicles operating in a fluid such as air or water.

The actual construction of such a device can be substantially varied but according to a simple arrangement the vehicle or missile has a nose mounted on a spherical bearing on the body of the vehicle or missile so that the axis of the nose can be deflected in relation to the axis of the body, driving means being provided to allow the nose angle to be varied, the driving means being applied between the nose and the body to allow universal orientation, but on a controlled pattern of the nose relative to the body.

The invention thus generally comprises a directional control for airborne and seaborne missiles comprising a body formed about a flight axis to move axially forward through the air or water, the body having a nose which forms a forward part which is deflectable angularly in relation to the flight axis of the body to form the guiding means for the missile by changing the fluid flow envelope over the body, and means between the nose and the body to effect the angular deflection.

The mechanism for deflecting the nose can be of many different forms but preferably a series of control means are placed on X and Y axes normal to each other, such as hydraulically operated or electrically operated push rods or cables which engage the nose and by differential use are able to deflect the nose in any plane.

The controls can be initiated in a required motion pattern by a microprocessor device or can be activated by radio control, or a homing system can be used which controls the missile motion according to prescribed guidance laws and in this way provides an effective device without the need to have extending fins or canards, a particular advantage in the case of missiles which require to be fired from a gun or released from a tube, such as a torpedo tube. If the control were mounted on a spinning missile such as a shell, the nose would generally need to be attached to the missile body by means of a bearing, and de-spun.

The junction between the nose and body can be faired to give minimal fluid flow interference and can include resilient means to ensure a smooth outer contour, and the nose could be sectional and covered by an elastic skin so that deflection of the nose can be progressive along its length according to the amount of control required.

The accompanying illustrations show typically how the nose of a missile can be mounted on the body to achieve directional control, but it is to be clear that the illustrations are by way of examples only and not to be taken as limiting the invention.

Figure 2:
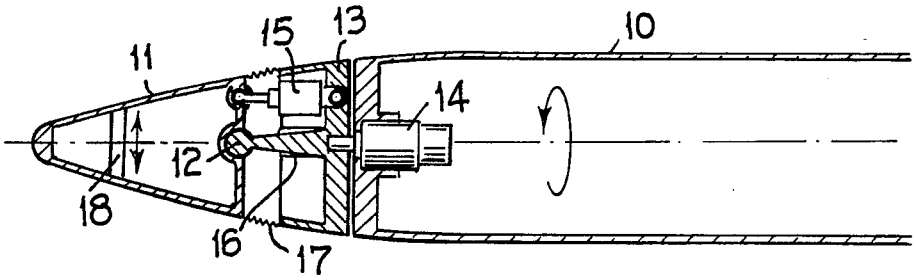
Figure 3:
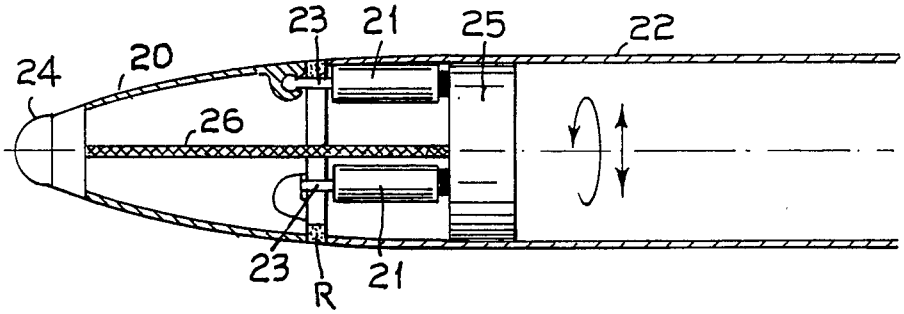

Referring now to the drawings;

FIGS. 1, 2 and 3 are sectioned views to illustrate the principle,

FIG. 1 showing a non-rotating missile.

FIG. 2 showing a spinning missile, and FIG. 3 showing a missile which can be non-rotational or spinning.

In FIG. 1 the missile 1 has a nose 2 universally pivoted at 3 and angled by motors 4 and 5 attached to the body 1 and arranged to tilt the nose 2 about X and Y axes (not marked) i.e. axes normal to each other. The dotted lines show how the nose tilts for steering purposes. The nose has at its rear a part spherical shape radial about the pivot bearing 3 to engaged a similarly shaped socket 6 on the body 1.

In FIG. 2 the missile 10 has a nose 11 carried on the tilt bearing 12 of a platform 13 which is rotatable in relation to the missile body by being mounted on the shaft of a despinning motor 14 carried by the missile body. Two motors 15 and 16 carried by the platform again tilt the nose for steering purposes, the nose 11 being faired into the platform 13 by a flexible membrane 17.

In FIG. 3 the nose 20 is carried on three motors 21 equally spaced around the periphery of the body 22, and the nose angle is controlled by differentially extending or retracting the shafts 23 of the motors 21.

The nose 20 and the body 22 are spaced apart but a resilient ring R extends across the gap. A seeking sensor 24 couples to a microprocessor 25 by leads 26 and the differential drive for the motors 21 is taken from the microprocessor, the shafts 23 of the motors being as said differentially generally axially movable under control of the microprocessor 25 to move the nose 20 in any angular direction.

Conditions met with can be summed up as follows:

In the case of a non-rolling body and nose, FIG. 1, roll stabilization of the body is achieved by standard methods, e.g., a roll rate sensor mounted in the body and a control system, the roll control torque being supplied by deflecting control surfaces, retracting spoilers, operating gas jets, etc., as is already known.

In the case of a rolling body, non or slowly rolling nose, the assembly of FIG. 2, applies where 14 represents the motor, the stator being attached to the body 10 and the motor being attached to the nose 13, to which is also attached a roll rate sensor 18. By appropriately controlling the speed of the motor by means of the roll rate sensor 18 the nose rotational speed is made very small.

For the systems outlined the simplest guidance system would be pursuit guidance against a designated target, following the system employed for laser guided bombs. Because of aerodynamic and gyroscopic effects the body 1, 10 or 22 closely aligns with the wind vector while the nose 2, 11 or 20 which contains a target detector points generally towards the target. Electrical error signals indicate the angle of deflection between the nose and body centerline and cause the actuators 4 and 5 (or 15 and 16) (or 21) to operate in such a way as to minimize the error signals. More sophisticated guidance systems could be produced by using a gyroscopic platform attached to the missiles, and sensors to monitor nose angular deflections and rates. A guidance system with an appropriate transfer function then operates the actuators and controls the missile to the target.

From the foregoing it will be realized that effective steering of a vehicle or missle which operates in a fluid and requires control in a number of planes is achieved in a highly simple manner without the need to apply external control means which would introduce unwanted factors such as obstructions projecting beyond the body of the vehicle or missile.

The claims defining the invention are as follows.

I claim:

1. A missile for airborne and seaborne use having directional control comprising:

a body formed about a flight axis to move axially forward along the flight axis through the air or water and being free to spin about said axis;

a nose pivotally carried by said body to be directionally deflectable angularly in relation to said axis to form steering means for said missile by changing the fluid flow envelope over said body;

means connected between said nose and said body operable to effect required angular deflection of said nose relative to said flight axis about at least two axes one normal to the other;

means to sense the orientation of said body about said axis;

means responsive to said sensing means to operate said operable means to maintain said nose at the required angular directional deflection irrespective of orientation changes of said body about said axis;

said connecting means including a platform pivotally carrying said nose and said operable means and rotationally supported about said axis by said body;

rotational drive means between said platform and said body; and means to control relative rotation between said body and said platform to maintain said nose non-rotational about said axis relative to said body.

2. A missile according to claim 1 wherein the operable means includes extendable means which support the nose from the body and angle said nose by differential extension.

3. A missile according to claim 1 wherein the nose is carried by the body by means of a plurality of motor means spaced around said body adjacent its periphery, each of said motor means being axially extendable and generally parallel to the flight axis to angle said nose by differential extension, and the responsive means includes means to control the differential extension of said motor means to angle said nose relative to said body.

4. A missile for airborne and seaborne use having directional control comprising:

a body formed about a flight axis to move forward in the axial direction through the air or water;

a nose at the forward end of said body;

support means on said body engaging said nose to pivot said nose on said body universally about said axis whereby the said nose is directionally deflectable angularly in relation to said axis to form steering means for said missile by changing the fluid flow envelope over said body;

means connected between said nose and said body operable to effect required angular deflection of said nose about at least two axes one normal to the other;

means to sense orientation and roll of said body about said flight axis;

means responsive to said sensing means to actuate said operable means to maintain said nose at the required angular directional deflection irrespective of orientation or roll of said body about said flight axis;

said support means comprising means at the rear part of said nose arranged to engage a spherical bearing disposed on said body on said flight axis, said rear part being of part-spherical shape radial about said spherical bearing to engage a similarly shaped socket in the forward part of said body.

5. A missile for airborne and seaborne use having directional control comprising:

a body formed about a flight axis to move axially forward along the flight axis through the air or water;

a nose pivotally carried by said body to be directionally deflectable angularly in relation to said axis to form steering means for said missile by changing the fluid flow envelope over said body;

means connected between said nose and said body operable to effect required angular deflection of said nose relative to said flight axis about at least two axes one normal to the other;

means to sense the orientation of said body about said axis;

means responsive to said sensing means to operate said operable means to maintain said nose at the required angular directional deflection irrespective of orientation changes of said body about said axis;

said sensing means and said responsive means including a seeking sensor coupled to a microprocessor having means to control said operable means to select the angle of deflection of said nose relative to said body.

6. A missile for airborne and seaborne use having directional control comprising:

a body formed about a flight axis to move forward in the axial direction through the air or water;

a nose at the forward end of said body;

support means on said body engaging said nose to pivot said nose on said body universally about said axis whereby the said nose is directionally deflectable angularly in relation to said axis to form steering means for said missile by changing the fluid flow envelope over said body;

means connected between said nose and said body operable to effect required angular deflection of said nose about at least two axes one normal to the other;

means to sense orientation and roll of said body about said flight axis;

means responsive to said sensing means to actuate said operable means to maintain said nose at the required angular directional deflection irrespective of orientation or roll of said body about said flight axis;

a platform rotationally supported by said body about said flight axis and carrying said support means;

rotational drive means between said platform and said body; and means responsive to said sensing means to operate said drive means to hold said platform non-rotational about said flight axis.

7. A missile for airborne and seaborne use having directional control comprising:

a body formed about a flight axis to move forward in the axial direction through the air or water;

a nose at the forward end of said body;

support means on said body engaging said nose to pivot said nose on said body universally about said axis whereby the said nose is directionally deflectable angularly in relation to said axis to form steering means for said missile by changing the fluid flow envelope over said body;

means connected between said nose and said body operable to effect required angular deflection of said nose about at least two axes one normal to the other;

means to sense orientation and roll of said body about said flight axis;

means responsive to said sensing means to actuate said operable means to maintain said nose at the required angular directional deflection irrespective of orientation or roll of said body about said flight axis;

a seeking sensor in said nose coupled to a microprocessor; and control means in said microprocessor to actuate said operable means to effect angling of said nose relative to said body.

* * * * *